United States Patent [19]

Hempel et al.

[11] 4,010,728

[45] Mar. 8, 1977

[54] CIRCULATING FIREPLACE SYSTEM

[75] Inventors: Rod A. Hempel, Huntington; Walter P. Tittman, Fort Wayne; Santosh D. Sheth, Huntington, all of Ind.

[73] Assignee: American Standard, Inc., New York, N.Y.

[22] Filed: June 2, 1975

[21] Appl. No.: 582,589

[52] U.S. Cl. ..... 126/120; 126/121

[51] Int. Cl.² ..... F24B 1/18

[58] Field of Search ..... 126/121, 122, 307; 98/46; 237/51, 55

[56] References Cited

UNITED STATES PATENTS

| | | | |
|---|---|---|---|
| 2,258,882 | 10/1941 | Craig | 126/121 |
| 2,322,016 | 6/1943 | Hardeman | 126/121 |
| 2,634,720 | 4/1953 | Thulman | 126/307 |
| 2,713,301 | 7/1955 | McKann | 98/46 |
| 2,821,975 | 2/1958 | Thulman | 126/120 |
| 3,082,758 | 3/1963 | Heiman | 126/110 |
| 3,094,980 | 6/1963 | Inabnit | 126/121 |
| 3,096,754 | 7/1963 | Howrey | 126/121 |
| 3,601,117 | 8/1971 | Carson | 126/121 |
| 3,724,443 | 4/1973 | Carson | 126/121 |
| 3,888,231 | 6/1975 | Galluzzo et al. | 126/120 |

*Primary Examiner*—John J. Camby
*Assistant Examiner*—Larry I. Schwartz
*Attorney, Agent, or Firm*—Robert G. Crooks; James J. Salerno, Jr.

[57] ABSTRACT

This circulating fireplace system preferably includes a fireplace comprising three metallic shells having air spaces between them for cooling purposes, together with a thermosiphonic chimney having three concentric tubular members coupled to the respective shells of the fireplace. Means is provided for impelling cooling air downward between the outer tubular members of the thermosiphonic chimney in addition to the air which would flow there by virtue of the thermosiphonic effect. Part of the air impelled down the chimney is used to cool the fireplace and then flows upward through the chimney to supplement the flue-cooling effect of the thermosiphonic air flow. The remainder of the impelled air is released from the fireplace either directly to the room or through ductwork in order to heat the room where the fireplace is located, or other rooms of the same structure.

19 Claims, 12 Drawing Figures

19
20
47
49
51
20
31
35
37
33
39
40
41
43

4
4
19
51
20
47
49
31
35
37
71
77
81
40
39
33
43
45
41
35
79
75
37
71

CIRCULATING FIREPLACE SYSTEM

CROSS REFERENCE TO RELATED INVENTIONS

The circulating fireplace system in accordance with the present invention may employ a prefabricated fireplace of the general type shown in U.S. Pat. No. 2,821,975—Thulman, together with a thermosiphonic chimney having certain features in common with the chimney of U.S. Pat. No. 2,634,720—Thulman, said thermosiphonic chimney being coupled to the fireplace to carry combustion products away from the fireplace and also to provide an air stream which cools the firebox of the fireplace as well as the flue and other members of the thermosiphonic chimney.

BACKGROUND OF THE INVENTION

Since the invention of the fireplace and thermosiphonic chimney in accordance with the respective United States patents of Robert K. Thulman, mentioned above, it has been possible to construct fireplaces and chimneys in a factory for future installation in residential or other buildings. Use of such factory-built fireplaces and chimneys has permitted the saving of construction expenses by limiting or eliminating the masonry work and material that had previously been necessary in the construction of a fireplace and the chimney therefor. Inasmuch as the outer surface of factory-built fireplaces and chimneys can be maintained at a temperature only slightly above that of the surrounding air, it has become possible to mount them in direct contact with wood or other combustible material used in the structure of a building. Moreover, elimination of a masonry chimney has rendered unnecessary the massive and expensive footings which had previously been required in order to furnish adequate support to masonry fireplaces and chimneys.

Although the factory-built fireplaces and chimneys as just described have caused much progress in construction methods by virtue of savings of time, material, and money, they have not in themselves provided much improvement in the heating of the structure in which they are accommodated.

Efforts have been made in the past to increase the amount of heat supplied by a factory-built fireplace to its environs within the structure that accommodates it. An example of one type of improvement is the so-called "circulator fireplace" as manufactured and marketed by The Majestic Company, a Division of American Standard Inc. situated in Huntington, Indiana. Such circulator fireplaces have heavy, double-walled steel fireboxes and are designed to be framed in masonry and used with a conventional masonry chimney. Circulator fireplaces provide paths for inward convection of air through openings low in one or both of the outer side walls of the fireplace structure whereby the air flows in to be heated by contact with an intermediate or an inner wall of the fireplace structure. The air so heated is then allowed to rise and return outwardly through an opening in the upper part of the outer fireplace wall to warm the room in which the fireplace is located. Sometimes circulator fans have been provided in order that the flow of air to be warmed by contact with the inner fireplace wall should not be entirely dependent upon convection. In any event, circulator fireplaces of this type have functioned simply by transferring a small amount of heat from the fireplace to the air in the room. Such a practice has not been very effective in heating the room in which the fireplace is located, and has not provided a convenient way to heat other rooms of the structure. Moreover, room air circulated between the walls of the fireplace has furnished no cooling to the flue of the chimney, through which the combustion products of the fireplace are discharged.

Accordingly, it is an object of our invention to provide a fireplace system in which a substantial amount of heat generated by combustion in the fireplace is made available to a room of the structure in which the fireplace is located.

Another object of our invention is to furnish a system in which a substantial amount of heat developed by combustion of fuel in the fireplace (or a similar source of heat) can be made available to rooms other than the room in which the fireplace is located.

A further object of our invention is to provide cooling of the chimney flue which is more effective than the cooling accomplished by the respective inventions disclosed in the two aforementioned Thulman patents. Such augmented cooling of the flue is especially important when an extremely hot fire is present in the firebox of the fireplace, thereby generating effluent gases of very high temperatures.

Still another object of our invention is to provide a fireplace system in which the degree of cooling of the chimney flue increases with the need for such cooling. An objective is to furnish a large volume of cooling air to the flue at the very times when an especially hot fire in the fireplace maximizes the need for cooling of the flue.

A still further object of our invention is to furnish a controllable source of heat to the room in which the fireplace is located, and optionally also to other rooms of the same structure.

SUMMARY OF THE INVENTION

Briefly, we have been able to fulfill the above-listed objects, and other objects of our invention, by providing a fireplace and chimney in which air is impelled through a special air-intake assembly into the outer duct of a thermosiphonic chimney. This impelled airflow supplements the air which would otherwise flow in the duct by reason of the thermosiphonic effect. The impelled air, and air induced thereby from above the chimney, are forced downwardly through the outer chimney duct into an outer zone of the fireplace. The fireplace, like the chimney, has three major structural components or shells, one within the other. The firebox and intermediate shell of the fireplace together define between them an *inner* fireplace zone. The intermediate fireplace shell and outer fireplace shell, on the other hand, define between them an *outer* fireplace zone. Air impelled downward through the outer chimney duct is directed into the outer fireplace zone, such air having been raised in temperature by picking up heat from the intermediate chimney pipe. Part of such air of raised temperature is allowed to pass through an opening in said intermediate fireplace shell into the inner fireplace zone, whereupon that portion of the air passes upwardly through the intermediate chimney duct around the chimney flue in order to cool the flue. The remainder of the air from the outer fireplace zone is discharged to the space around the fireplace either directly through an opening in the outer fireplace shell or through ductwork coupled to a shell of the fireplace. In a conventional house of significant height, such ductwork may be coupled to an opening in the outer fireplace shell. On the other hand, in a mobile home or other low structure in which a factory-built fireplace is installed, such ductwork may pass through the outer fireplace zone and be coupled to an opening in the intermediate fireplace shell whereby the ductwork receives air that has been passed from the outer fireplace zone to the inner fireplace zone. The impetus forcing air downward through the outer chimney duct may be supplied by a motor-driven blower mounted either in a cap at the top of the thermosiphonic chimney or in another type of air-intake assembly which may be accommodated in attic space adjacent the thermosiphonic chimney.

For a full understanding of our invention, reference should now be made to the following complete description of a preferred embodiment of our invention, taken in conjunction with the appended claims and the attached drawings.

DESCRIPTION OF A PREFERRED EMBODIMENT

Figure 1:
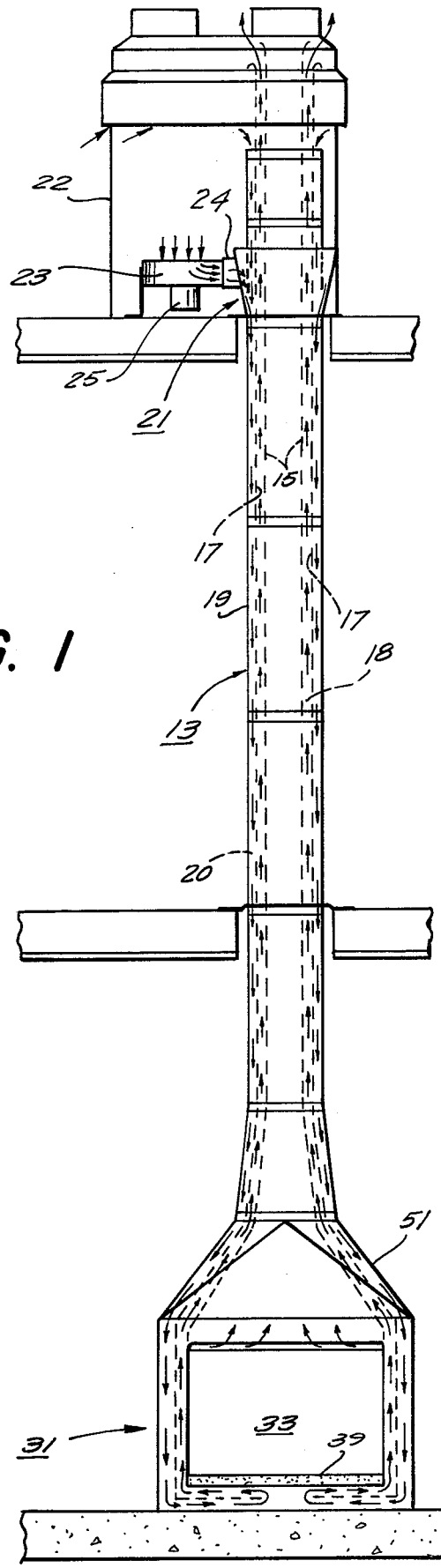
FIG. 1 is a schematic front-elevation view of a fireplace system in accordance with our invention, including a thermosiphonic chimney and chimney cap as well as the fireplace per se.
Figure 2:
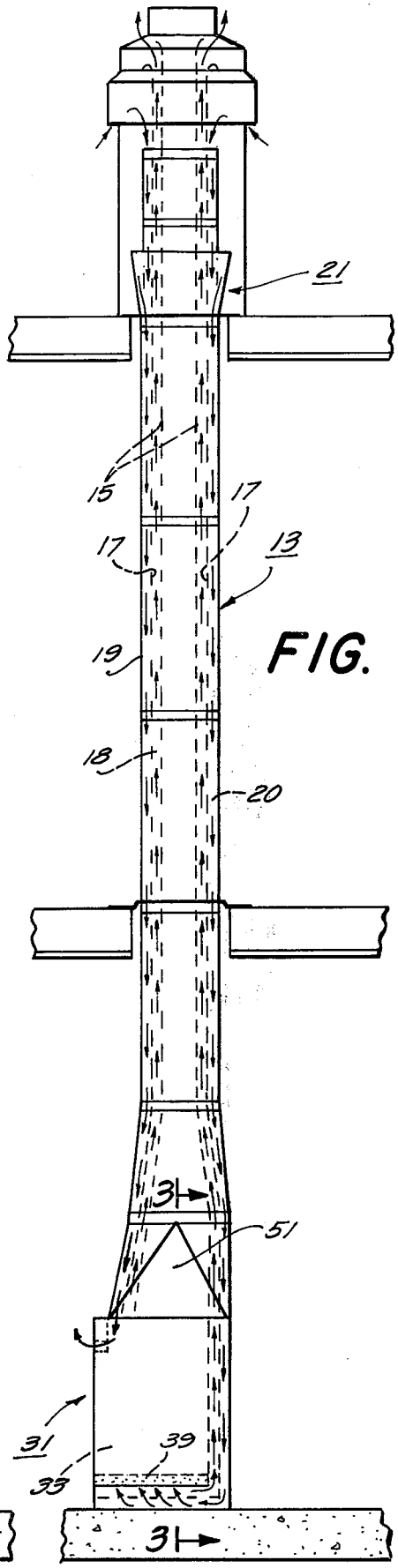
FIG. 2 is a schematic side-elevation view of the fireplace system. Both FIG. 1 and FIG. 2 include schematic representations of air-flow paths within the system.

Turning to FIG. 1 and FIG. 2 of the drawings, one embodiment of the entire fireplace system is represented schematically. The basic components of the system are a thermosiphonic-chimney assembly 13, an air-intake assembly 21, and a fireplace assembly 31.

Thermosiphonic-chimney assembly 13, which may be constructed partly in accordance with the teachings of U.S. Pat. No. 2,634,720—Thulman, includes at its core a flue 15 for conveying combustion products from the firebox 33 of fireplace assembly 31 and discharging them into the atmosphere. Flue 15 may be constructed of stainless steel, or some other material having considerable strength and the ability to resist very high temperatures without melting or suffering substantial oxidation.

Concentric with flue 15 and spaced therefrom by internal braces is an intermediate chimney pipe 17. Intermediate chimney pipe 17 must be able to withstand high temperatures, but not as high as those which flue 15 is required to withstand. Accordingly, aluminized steel is material which is satisfactory for use in intermediate chimney pipe 17.

The outermost member of thermosiphonic-chimney assembly 13 is an outer chimney pipe 19, which is substantially concentric with both flue 15 and intermediate chimney pipe 17 and is spaced frm intermediate chimney pipe 17 by internal braces. Inasmuch as the operation of thermosiphonic-chimney assembly 13 causes the existence of a temperature gradient in a radial direction in the assembly, the usual operating temperature of outer chimney pipe 19 is much lower than those of either of the other two principal members of thermosiphonic-chimney assembly 13. Accordingly, outer chimney pipe 19 may be fabricated of galvanized steel or some other relatively inexpensive but strong material.

Flue 15 and intermediate chimney pipe 17 define between them an intermediate chimney duct 18. In the thermosiphonic mode of operation of the chimney assembly and of the fireplace system, the air within intermediate chimney duct 18 is heated by contact with, or radiation from, flue 15 and therefore is characterized by a reduced density. By reason of its reduced density, the air in intermediate chimney duct 18 rises and passes through the chimney assembly to the top thereof, and then enters the outdoor atmosphere. In rising through intermediate chimney duct 18, this air removes sufficient heat from flue 15 to maintain the flue temperature at a level such that it does not undergo substantial damage.

Intermediate chimney pipe 17 and outer chimney pipe 19 together define between them an outer chimney duct 20. The air in outer chimney duct 20 has a temperature which is lower than that of the air in intermediate chimney duct 18. Accordingly, the air in outer chimney duct 20 has a density higher than that of the air in intermediate chimney duct 18 and tends to fall through outer chimney duct 20 into the space between the outer shells of fireplace assembly 31. By means which will be explained in describing the components of fireplace assembly 31, air from outer chimney duct 20 is allowed to pass into the lower extremity of intermediate chimney duct 18. It then absorbs heat from firebox 33, undergoes expansion, and rises through intermediate chimney duct 18, cooling flue 15 as it continues to rise through intermediate chimney duct 18. The foregoing paragraphs briefly explain the operation of the thermosiphonic chimney.

In accordance with our invention, we provide a remarkable augmentation of the flow of air both downward through outer chimney duct 20 and upward through intermediate chimney duct 18. For that purpose, we employ an air-intake assembly 21 having a blower 23 driven by a motor 25 as shown in greater detail in FIG. 7 and FIG. 8 of the drawings and to be fully described later in this specification. Air-intake assembly 21 is illustrated in FIG. 1 and FIG. 2 of the drawings as being accommodated within a chimney cap 22 which would typically be mounted at the head of thermosiphonic-chimney assembly 13 on top of the roof of a building. However, air-intake assembly 21 might alternatively be mounted in an adequately ventilated attic space *beneath* the roof of the building. It is advantageous to mount air-intake assembly 21 in either of these locations, thereby permitting fresh atmospheric air to be drawn into the fireplace system and expelled, properly heated, into the structure. In this way, the oxygen in the atmosphere within the room containing the fireplace, and rooms communicating therewith, is not depleted, as it would be if this air were to be directly drawn from those rooms.

Figure 8:
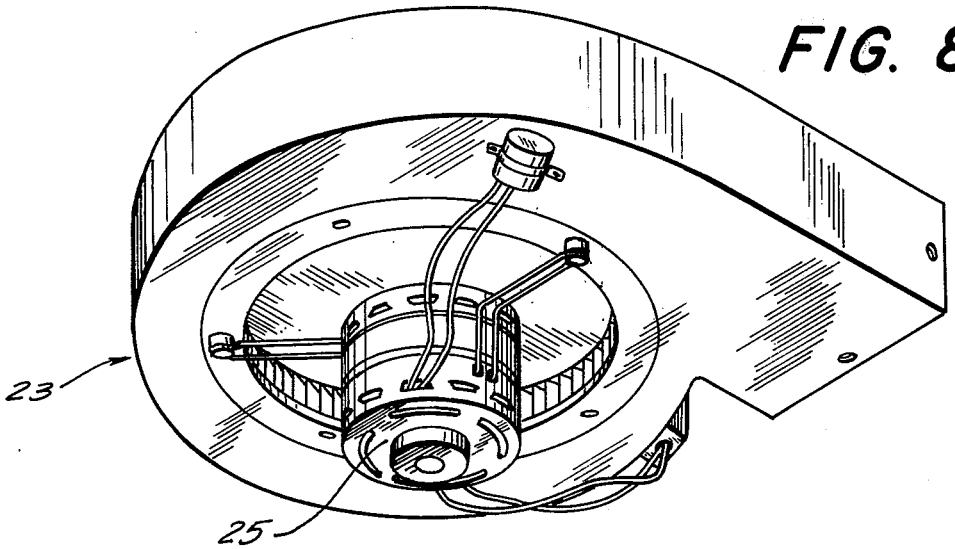
FIG. 8 is a perspective representation of a blower-and-motor combination for impelling air into the air-intake structure of FIG. 7.

Referring to FIG. 8 of the drawings by way of further explanation of the components of air-intake assembly 21, blower 23 may be a common type of radial-flow fan, which impels air tangentially from the blades on its periphery. Motor 25 may be an electric induction motor rated between about one-sixth and one-third horsepower.

Figure 7:
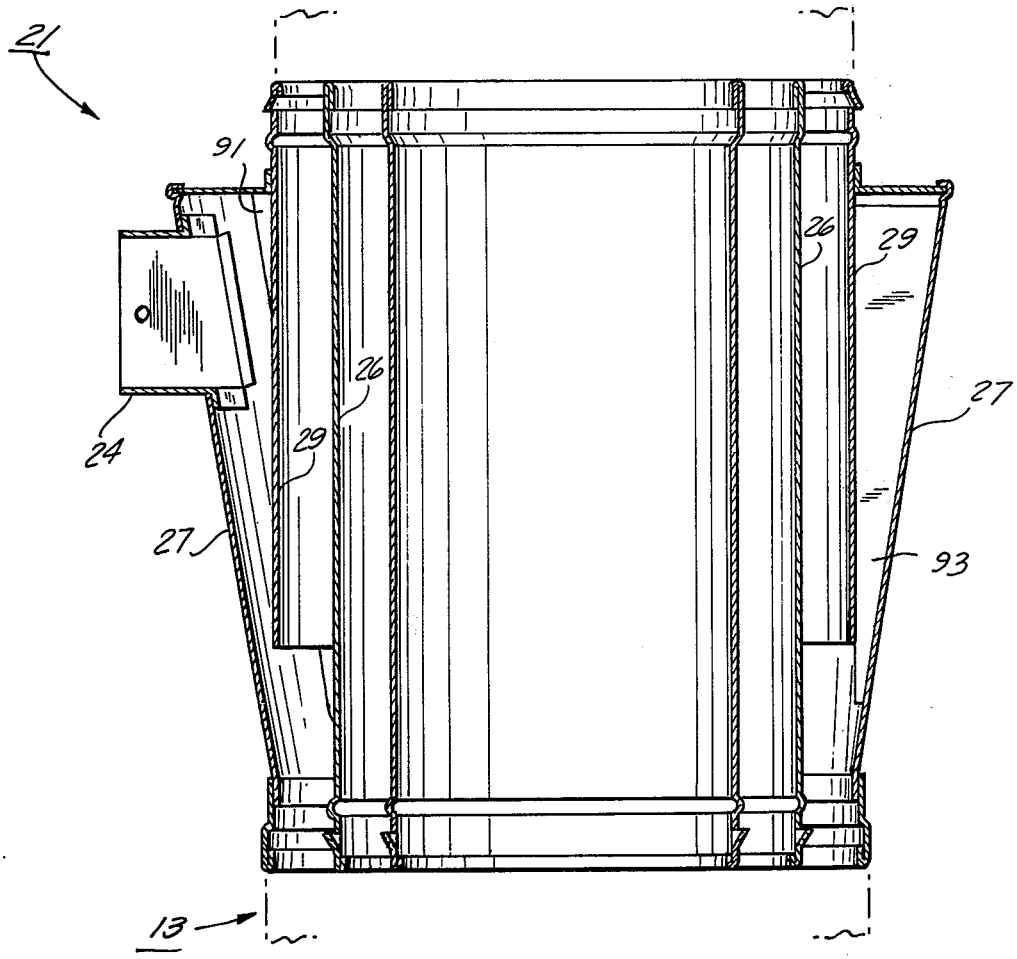
FIG. 7 is a detail sectional view of an air-intake structure, illustrating the way in which such structure is associated with a thermosiphonic chimney.

Blower 23 impels air into an air-intake duct 24, which in turn delivers the air to the space between an air-intake outer shell 27 and an air-intake intermediate shell 29 as illustrated in detail in the sectional view of FIG. 7 of the drawings.

Air-intake intermediate shell 29 corresponds in diameter to outer chimney pipe 19 of thermosiphonic-chimney assembly 13. However, in air-intake assembly 21, there is a gap between air-intake intermediate shell 29 and the upper extremity of outer chimney pipe 19 below it. Such gap, in a typical chimney assembly having a flue approximately 8 inches in diameter, may be approximately 5¼ inches. In such an air-intake assembly and chimney assembly, intermediate chimney pipe 17 may have a diameter of approximately 11 inches, whereas outer chimney pipe 19 and air-intake intermediate shell 29 may have a diameter of approximately 13½ inches.

Air-intake outer shell 27 of air-intake assembly 21 is frustoconical in configuration and surrounds air-intake intermediate shell 29 in such a way as to define therewith a tapered nozzle. The nozzle directs downward the air which is forced into it through air-intake duct 24 by blower 23. The velocity of the air passing through the nozzle and into outer chimney duct 20 of thermosiphonic-chimney assembly 13 is such that its pressure is reduced. Accordingly, additional air tends to flow from the atmosphere through the upper communicating outer thermosiphonic-chimney duct into a space between air-intake intermediate shell 29 and an air-intake inner shell 26 concentric therewith and having a diameter substantially equal to that of intermediate chimney pipe 17.

When blower 23 is not in operation, atmospheric air entering the space between air-intake inner shell 26 and air-intake intermediate shell 29 and passing thence downward through outer chimney duct 20 is essentially the thermosiphonic air flow which would occur in a thermosiphonic chimney as described in previous paragraphs. However, when blower 23 is in operation, the air flow induced through the space between air-intake inner shell 26 and air-intake intermediate shell 29 is substantially greater than the air flow which would take place of blower 23 were not in operation. Moreover, when that augmented air flow is combined with the air flow through the nozzle between airintake outer shell 27 and air-intake intermediate shell 29, the total rate of air flow downward into and through outer chimney duct 20 is a great deal higher than would occur in the outer chimney duct of a prior-art thermosiphonic chimney. The degree to which that air flow is increased over the prior-art type of chimney will be quantified mathematically later in this specification. In the meantime, it will be necessary to explain the structure and function of a fireplace assembly suitable for use with thermosiphonic-chimney assembly 13 and air-intake assembly 21 as they have been described.

Figures 3, 4:
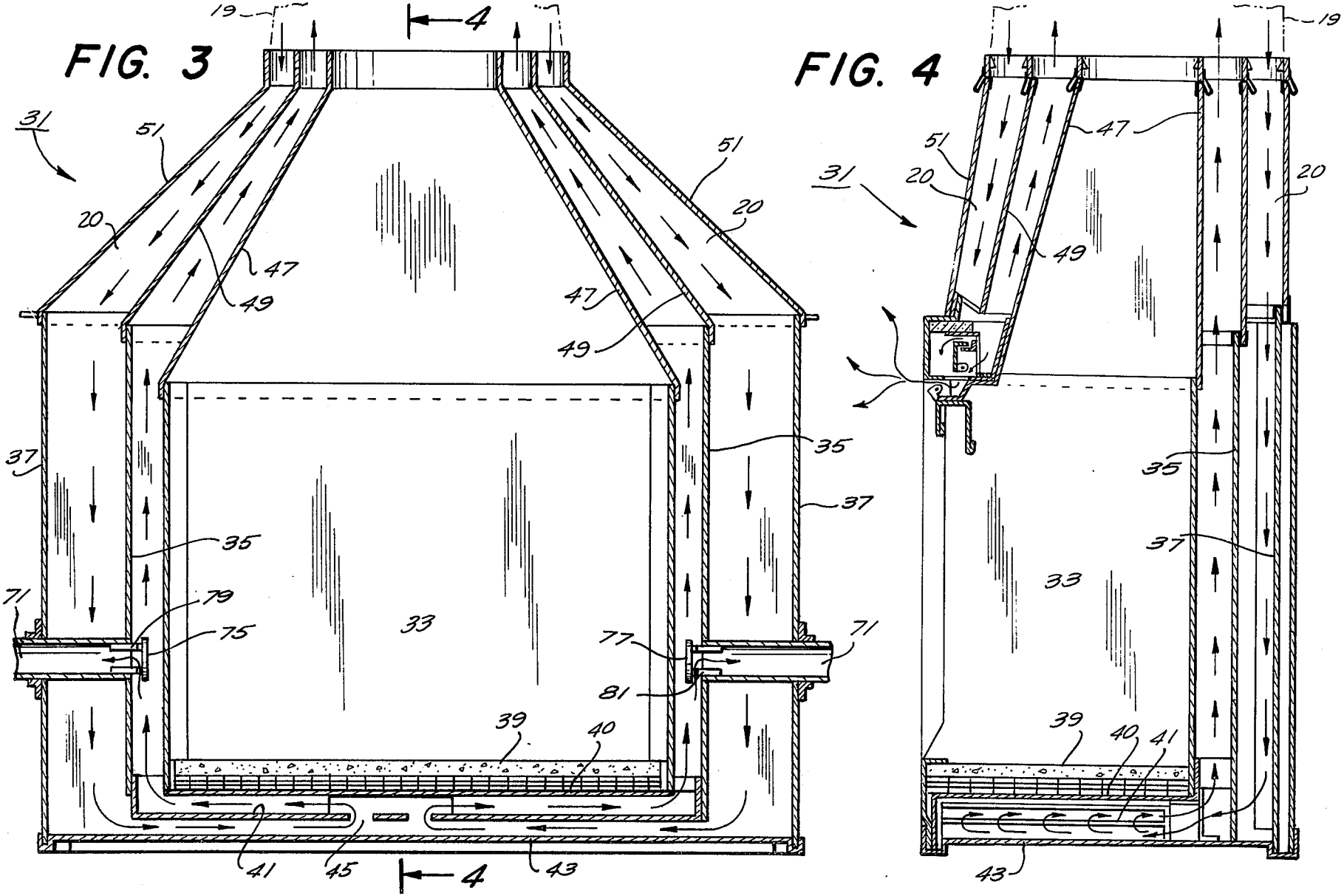
FIG. 3 is an enlarged sectional view of the fireplace portion of the system illustrated in FIGS. 1 and 2, taken along line 3—3 of FIG. 2.
FIG. 4 is an enlarged sectional view in side elevation taken along the vertical plane 4—4 of FIG. 3. Both FIG. 3 and FIG. 4 include schematic representations of air-flow paths within the fireplace.

Fireplace assembly 31 will be best understood by referring to FIGS. 3 and 4 of the drawings, which are sectional views as seen from orthogonal directions.

The basic components of fireplace assembly 31 are a firebox 33, an intermediate fireplace casing 35 surrounding firebox 33 and spaced therefrom, and an outer fireplace casing 37, which in turn surrounds intermediate fireplace casing 35 and is spaced therefrom so as to leave an air zone between them. Metallic spacers within fireplace assembly 31 maintain the separation of firebox 33 from intermediate fireplace casing 35 and the separation of intermediate fireplace casing 35 from outer fireplace casing 37.

At the bottom of firebox 33 is a hearth 39, upon which the combustion of wood or other material can take place within the firebox. Hearth 39 may desirably be a clay-based refractory material capable of withstanding temperatures of at least 2,000° F. Hearth 39 may be supported upon thermal-insulating material such as rockwool, which in turn rests upon a metallic suport member 40.

Below metallic support member 40, and spaced therefrom by metallic members, is a base liner 41 oriented in a substantially horizontal plane so as to define a zone between itself and metallic support member 40. For reasons which will subsequently be explained, base liner 41 should have at least one base opening 45 therein. Below base liner 41 and spaced therefrom is a base plate 43 which constitutes the structural foundation of fireplace assembly 31. Base plate 43 is spaced from base liner 41 by metallic spacers or baffles to define an air zone therebetween.

At the top of fireplace assembly 31, firebox 33 is connected to a combustion dome 47 having a generally pyramidal shape. The cross section of combustion dome 47 in a horizontal plane tapers from the cross section of firebox 33, which is generally trapezoidal, to a narrower and generally circular cross section at the upper extremity of combustion dome 47. Thus, although combustion dome 47 appears to have an essentially pyramidal shape, it functions as an adapter from the trapezoidal cross section of firebox 33 to the circular cross section which characterizes flue 15 at the base of thermosiphonic-chimney assembly 13.

When fireplace assembly 31 is manufactured, generally in an industrial plant, combustion dome 47 can be permanently fastened to firebox 33 by welding or some other irreversible fastening means. When fireplace assembly 31 is installed in the house or other structure where it is to be permanently located, thermosiphonic-chimney assembly 13 is mounted atop fireplace assembly 31, and combustion dome 47 is at that time coupled to flue 15 of thermosiphonic-chimney assembly 13 by virtue of an overlapping fit between the material of flue 15 and of combustion dome 47. If desired, a further adapter, or so-called "starter section," may be interposed between the top of fireplace assembly 31 and the base of thermosiphonic-chimney assembly 13.

Inasmuch as combustion dome 47 bears the full brunt of thermal radiation from the combustion of the fuel in firebox 33, combustion dome 47 should be made of stainless steel or some other very heat-resistant material.

Surrounding combustion dome 47 and spaced therefrom is an intermediate dome 49 having a shape similar to but larger than that of combustion dome 47. Intermediate dome 49 may be formed of aluminized steel, or other material having substantial heat resistance but not necessarily a heat resistance as great as that of combustion dome 47. When fireplace assembly 31 is coupled to thermosiphonic-chimney assembly 13 in the house or other structure, intermediate dome 49, which was included at the factory as part of fireplace assembly 31, is then coupled to intermediate chimney pipe 17 of thermosiphonic-chimney assembly 13 by means of an overlapping fit or other reasonably tight joint.

Finally, an outer dome 51, part of the factory-built fireplace assembly 31, mates with outer chimney pipe 19 of thermosihonic-chimney assembly 13 when fireplace assembly 31 is installed, along with thermosiphonic-chimney assembly 13, in its permanent location. Outer dome 51, like outer fireplace casing 37, may be fabricated from galvanized sheet steel.

Figure 6:
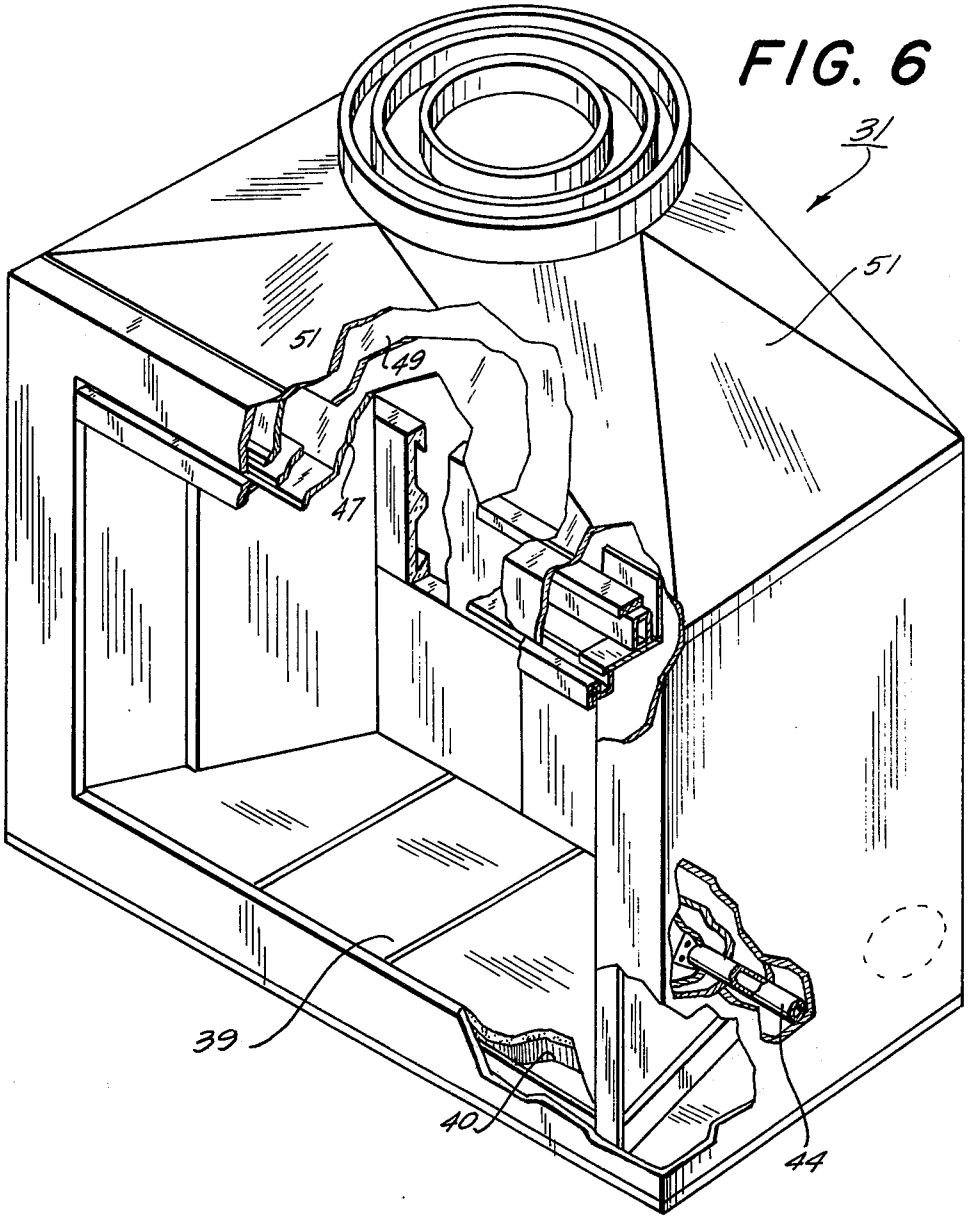
FIG. 6 portion a perspective representation, partly broken away, of the fireplace portin of the system, illustrating thermal insulation incorporated into the fireplace and certain accessories associated therewith.

The way in which outer dome 51 overlies intermediate dome 49, which in turn surrounds and is spaced from combustion dome 47, is graphically illustrated by the cut-away portion of FIG. 6 of the drawings. Likewise, the flanges at the upper extremities of the respective domes of fireplace assembly 31 are clearly shown in FIG. 6, which illustrates graphically the way in which the three members of thermosiphonic-chimney assembly 13 respectively fit over and couple with the flanges of the fireplace domes.

Other features which are illustrated clearly in FIG. 6 are hearth 39, and the layer of rockwool or other insulation interposed between hearth 39 and its metallic support member 40.

Finally, FIG. 6 also shows, through the cut-away portion at the lower right-hand corner of the figure, a gas pipe-line tube 44 which passes through both intermediate fireplace casing 35 and outer fireplace casing 37 and penetrates firebox 33 in order to supply fuel gas to a so-called "fire log" which may be installed within firebox 33 if the operator of the fireplace desires a gas fire as distinguished from a wood fire.

Figure 5:
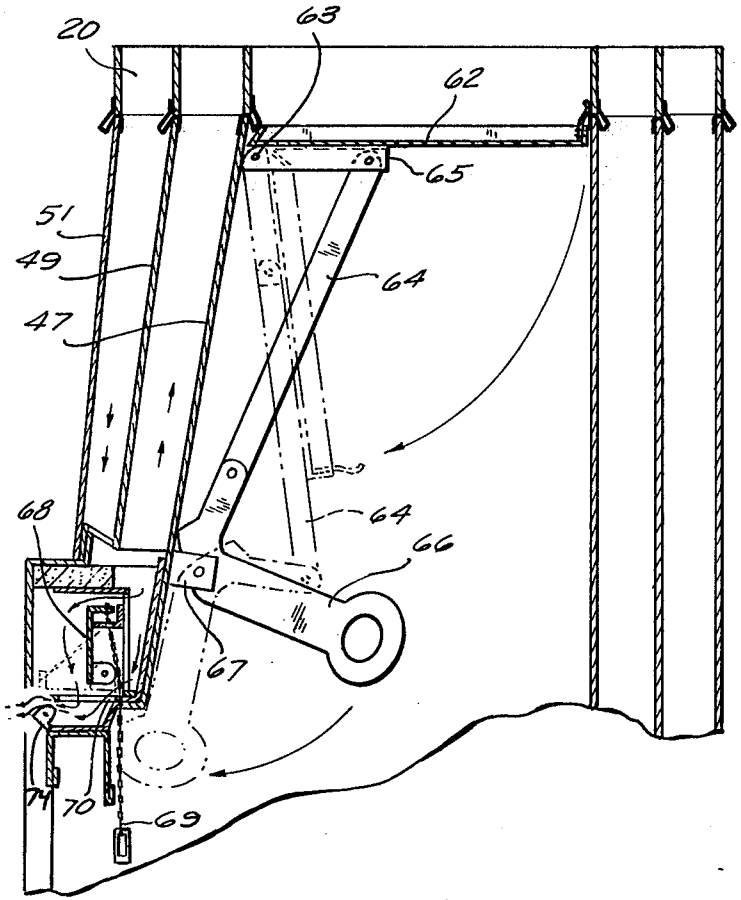
FIG. 5 is an enlarged section of a fragment of FIG. 4, including in addition a portrayal of means for operating a damper and an air-outlet door of the fireplace.

Returning to FIG. 4 of the drawings, we note at the left-hand side of the figure two features which are illustrated in enlarged representation in FIG. 5 of the drawings. The first of these features is the fireplace damper, whereas the second of the features is a controllable means governing the flow of heated air from outer chimney duct 20, and from the zone between intermediate dome 49 and outer dome 51 of the fireplace, into the space external to the fireplace.

The fireplace damper assembly comprises a damper blade 62 which is pivoted about a hinge 63 and which is operated by means of a link 64 coupled through a pin to a rib 65 permanently attached to damper blade 62. Link 64 is coupled to a control handle 66 which in turn is pivoted on a bracket 67 attached to the inner surface of combustion dome 47. Inasmuch as control handle 66 is located in one of the hottest regions of the fireplace, it should be made of cast iron or other very heat-resistant material. Operation of control handle 66 downward, as indicated in dotted lines in FIG. 5, causes damper blade 62 to pivot downward, thereby opening the passageway from combustion dome 47 into flue 15 of thermosiphonic-chimney assembly 13.

Turning now to the means for controlling egress of heated air into the room or other space external to the fireplace, FIG. 5 illustrates a door 68 pivoted to a bracket mounted on a flange of combustion dome 47 and permitted to rotate through an angle of approximately 90°. When the operator of the fireplace pulls on a chain assembly 69, door 68 rotates about its pivot and moves into the vertical position depicted in FIG. 5. In that position, opening 70 is uncovered, permitting heated air to pass therethrough and to exit into the room as guided by a baffle 74. Thus, of the air which has descended through outer chimney duct 20 and which has become heated by contact with intermediate chimney pipe 17, one portion may be discharged through opening 70 past baffle 74 and into the room. The remainder of the air passes between intermediate fireplace casing 35 and outer fireplace casing 37, at least a portion thereof then flowing through base opening 45 into the zone between metallic support member 40 and base liner 41. From that location, the air passes upward between firebox 33 and intermediate fireplace casing 35 in order to cool the firebox, and thence passes between combustion dome 47 and intermediate dome 49 to enter intermediate chimney duct 18 Finally, the air rises through thermosiphonic-chimney assembly 13, cooling flue 15 as it goes.

We are now able to understand how two of the objectives of our invention have been fulfilled. Air which has been heated in outer chimney duct 20 is discharged into the room through opening 70, thereby heating the room more than it would be heated by mere radiation from the fire in the fireplace. Moreover, the flow of cooling air upward through intermediate chimney duct 18 is increased when blower 23 is in operation, as compared with the mode of operation in which such cooling depends only upon thermosiphonic circulation.

The degree to which heat is supplied to the room, and cooling is furnished to firebox 33, combustion dome 47 and flue 15 depends to a considerable extent on the operation of blower 23. *However, it is important that the cooling effect remain substantial even when blower 23 is not in operation.* For instance, in the event of power failure during a bad storm, thereby preventing operation of motor 25, which drives blower 23, it would be important still to be able to use the fireplace. Such operation of a fireplace system in accordance with our invention is safe because adequate cooling of firebox 33, combustion dome 47, and flue 15 can be accomplished by thermosiphonic circulation alone.

Figure 9:
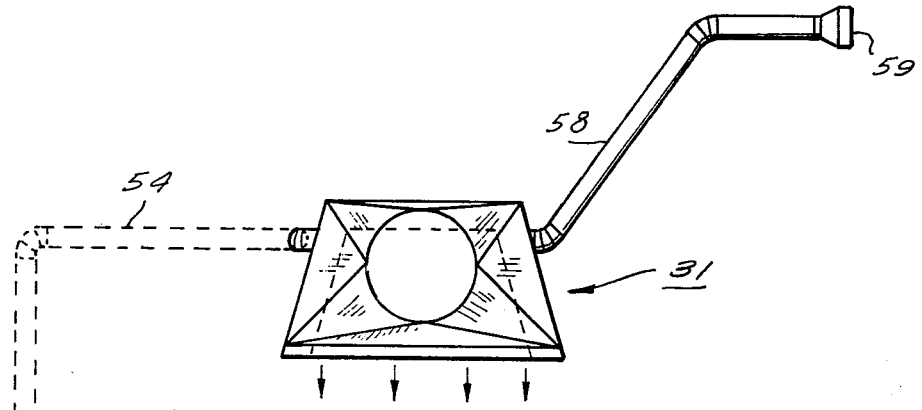
FIG. 9 is a top view of a fireplace, including also certain ductwork connected thereto for delivering to the environs of the fireplace heated air derived from a zone of the fireplace.
Figure 10:
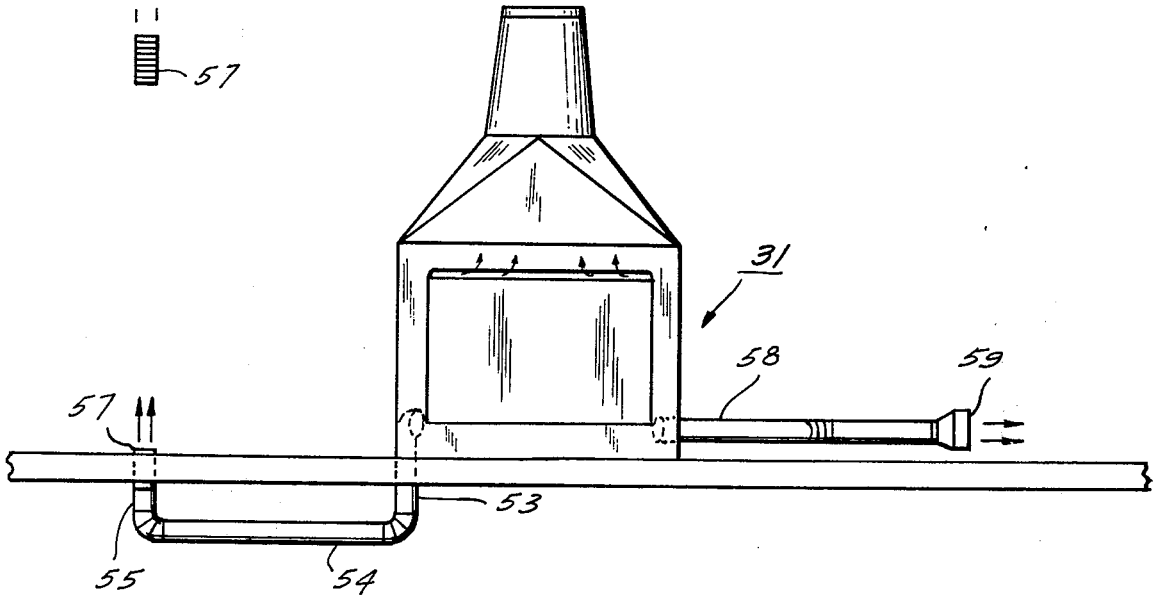
FIG. 10 is a front-elevation view of the fireplace and ductwork illustrated in FIG. 9.

In the event that it is desired to convey heat from the fireplace to a remote portion of the room in which the fireplace is located, or to another room, we have found it possible to convey heated air from the space between intermediate fireplace casing 35 and outer fireplace casing 37 through ductwork as illustrated in FIGS. 9 and 10 of the drawings. In those figures, an opening near the base of outer fireplace casing 37 is coupled through a vertical room-heating duct 53 and a horizontal room-heating duct 54 to another vertical room-heating duct 55, which terminates in a horizontal register 57 through which heated air is discharged. Another branch of horizontal room-heating duct 58 coupled to another opening near the base of outer fireplace casing 37 terminates in a vertical register 59, through which heated air may also be discharged.

In buildings of full height, the cooling effect produced by the thermosiphonic effect in the fireplace assembly and chimney assembly will almost always be sufficient for safety. Also, in buildings of full height, heated air may be taken away from the fireplace through ductwork as illustrated in FIGS. 9 and 10 of the drawings. In structures of *lesser* height, such as mobile homes, the circulation produced by the thermosiphonic effect generally will still be sufficient to produce a flow of air adequate for cooling the firebox and flue. However, the surface area for transfer of heat from the intermedite chimney pipe to the air flowing downward in outer chimney duct 20 is limited in the special case of structures of lesser height, wherein the length of the chimney assembly is considerably less than in the case of buildings of full height. Therefore, the heat imparted to the air in passing downward through outer chimney duct 20 may not be sufficient in mobile homes to raise the temperature of the air to a level sufficiently high that the air will be suitable for immediate discharge into the room for heating purposes. In that event, we have found it desirable to take air for heating purposes fro the *intermediate* zone between firebox 33 and intermediate fireplace casing 35 rather than from the *outer* zone between intermediate fireplace casing 35 and outer fireplace casing 37. This structural variation is illustrated in FIG. 3 of the drawings. Therefore, for mobilehome or other low-rise applications, we provide a room-heating duct 71 which passes through the wall of outer fireplace casing 37 and terminates at an opening in intermediate fireplace casing 35 having the same diameter as room heating duct 71. We have found that, if room-heating ducts are coupled to the *intermediate* zone rather than to the *outer* zone, heated air should not also be taken from the fireplace through a frontal opening such as opening 70 in FIG. 5. Although we recommend that, for fireplaces installed in mobile homes, the ductwork be coupled to the *intermediate* zone of the fireplace, we recognize that such a coupling of the ductwork to the intermediate zone of the fireplace may also be used in fireplace installations in buildings of full height.

If we use a room-heating duct 71 coupled to the intermediate zone of the fireplace, rather than to the outer zone thereof, care must be taken to prevent direct radiation from the outer surface of firebox 33 from creating a "hot spot" within or at the far end of room-heating duct 71. For that purpose, radiation shields 75 and 77 may be mounted on intermediate fireplace casing 35 by means of respective stand-offs 79 and 81 as illustrated in FIG. 3 of the drawings.

Figure 11:
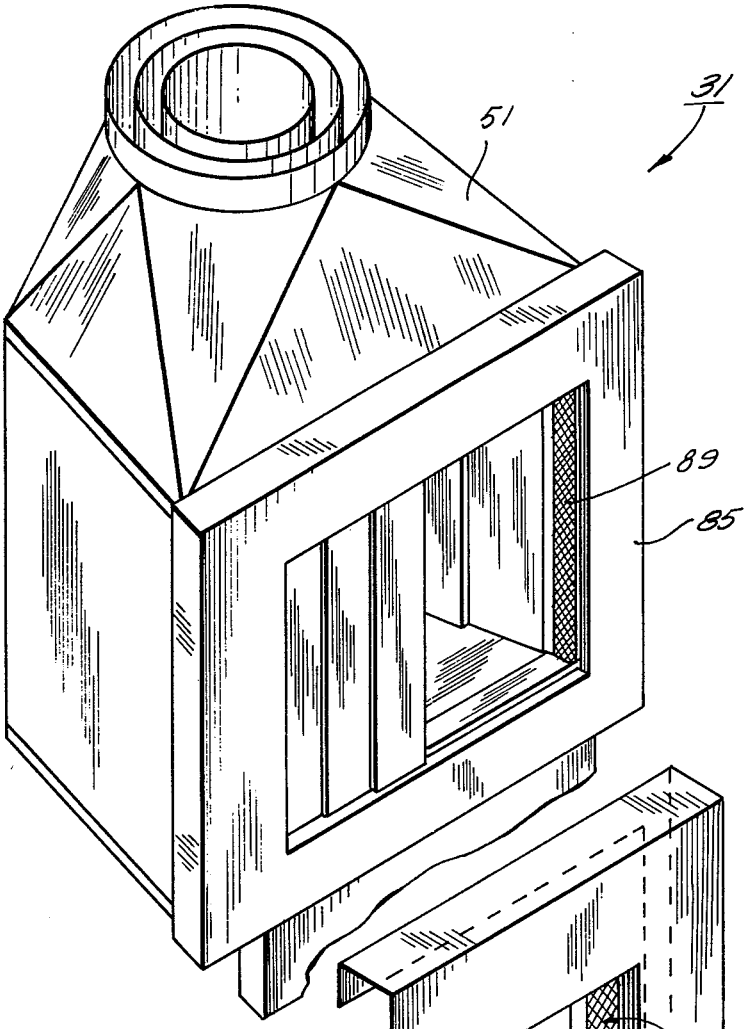
FIG. 11 is a perspective view of a fireplace having mounted thereon an open duct for delivering make-up air thereto, and showing an air-input duct for deriving make-up air from the space below the fireplace.
Figure 12:
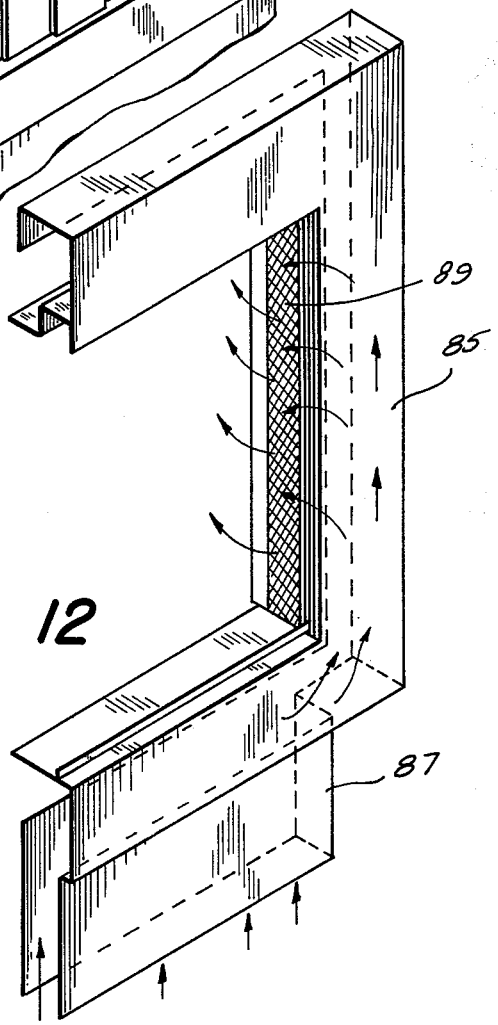
FIG. 12 is a perspective view, partly cut away, of the open duct and air-input duct illustrated in FIG. 11, and showing the cross sections of the open duct and air-input duct respectively.

Another problem which arises in mobile homes, in addition to the low-rise nature of the chimney, is the fact that mobile homes are frequently made nearly air tight. Thus, air from the atmosphere cannot easily get into the mobile home to replace oxygen consumed by the fire in a fireplace installed in such a mobile home. Depletion of the oxygen level within the mobile home can be dangerous as well as unpleasant. Accordingly, we have found it desirable to provide an independent supply of atmospheric air to the fireplace for "make-up" purposes. As illustrated in FIGS. 11 and 12 of the drawings, we provide for use in mobile homes a "surround" 85 of open ductwork having the form of a "picture frame" around the frontal opening of the fireplace. The cross section of surround 85, and of the open ductwork which constitutes it, is illustrated in FIG. 12. Air from below the mobile home is introduced into surround 85 through an air-input duct 87 and is then discharged into firebox 33 through screen work 89 installed over the open face of the surround on two of the four sides thereof.

It has been mentioned that the objects of our invention can best be fulfilled if a rather high rate of air flow is provided into outer chimney duct 20. This high rate of flow comprises both the air passing through blower 23 and the air flow which is induced from the atmosphere between air-intake inner shell 26 and air-intake intermediate shell 29 of air-intake assembly 21. The furnishing of warmed air to the room and of cooling to the firebox and flue is most effectively achieved if the air flow entering outer chimney duct 20 and passing downward therethrough is reasonably smooth. In order to insure the smoothness of flow of air through air-intake assembly 21 and into outer chimney duct 20, we provide therein air-flow fins 91 and 93 as illustrated in FIG. 7 of the drawings. These fins are substantially triangular and are located in vertical planes which pass through the axis of air-intake assembly 21.

The improvement in cooling of firebox 33 and of all members of thermosihonic-chimney assembly 13 when blower 23 is in operation is very striking. In order to demonstrate that improvement, we have made measurement in a typical installation of our fireplace system having therein a rate of heat generation of approximately 140,000 B.t.u. per hour. Such a known rate of heat can be generated by the "gas log" to which reference has already been made. When the blower of a typical fireplace system is running and temperatures are measured at the top of a 20-foot chimney assembly, we have found the following temperatures:

284° F at the top of flue 15;
92° F at the top of intermediate chimney pipe 17; and
79° F at the top of outer chimney pipe 19.

By contrast, when the blower of the same fireplace system is *not running*, we have measured temperatures at the top of the same 20-foot chimney as follows:

319° F at the top of flue 15;
164° F at the top of intermediate chimney pipe 17; and
94° F at the top of outer chimney pipe 19.

When the rate of heat input to the same system was increased to the level of 200,000 B.t.u. per hour, and when the ambient temperature was 76° F, the temperatures with the blower running were as follows:

329° F at the top of flue 15;
131° F at the top of intermediate chimney pipe 17; and
119° F at the top of outer chimney pipe 19.

By contrast, with the blower *not running*, the temperatures were sharply higher, as follows:

376° F at the top of flue 15; 218° F at the top of intermediate chimney pipe 17; and
152° F at the top of outer chimney pipe 19.

The improved cooling of the various components of thermosiphonic-chimney assembly 13 by use of our invention is evidenced in the temperature tabulations just set forth. It is important that this improvement in cooling of the otherwise hot members of the chimney assembly is accompanied by the furnishing of substantial heat to the environment in which the fireplace is installed. The amount of heat which can be furnished to the environment depends heavily upon the rate of air flow downward through outer chimney duct 20, which is in turn determined by the respective rates of air flow through blower 23 and of induced air flow between air-intake inner shell 26 and air-intake intermediate shell 29 of air-intake assembly 21. The substantial improvements in these rates of flow attributable to our invention can be illustrated by means of several equations of flow. These equations are stated in terms of quantities defined as follows:

The quantities represent mass rates of flow of air through designated ducts or openings of the system. The *first* defined quantity designates a mass rate of flow which prevails only when blower 23 is *not in operation*. All other defined quantities designate mass rates of flow when blower 23 *is* in operation.

T is the flow downward through outer chimney duct 20 resulting only from thermosiphonic action. In view of the relatively small pressure differentials which prevail under pure thermosiphonic conditions, the quantity T also represents very closely the flow *upward* through intermediate chimney duct 18.

F is the flow downward through outer chimney duct 20 when blower 23 is in operation. F also represents the sum of flow rates B and I, respectively defined as follows:

B is the flow through blower 23 and air-intake assembly 21 into outer chimney duct 20 when blower 23 is in operation.

I is the flow downward between air-intake inner shell 26 and air-intake intermediate shell 29 of air-intake assembly 21 when blower 23 is in operation.

R is the flow into the room through opening 70 from the space between intermediate fireplace casing 35 and outer fireplace casing 37.

D is the total flow, from the space between the fireplace casings, into heating ducts 53 and 58 for delivery of heated air to destinations remote from the fireplace.

C is the flow upward through intermediate chimney duct 18 when blower 23 is in operation.

The three principal equations, incorporating the quantities defined above are as follows:

$$F = B + I$$

$$F = C + R + D$$

$$B + I = C + R + D$$

The first of the equations reproduced above simply states that the rate of air flow forced downward in outer chimney duct 20 when blower 23 is in operation is the sum of the flow B through blower 23 and the flow I between air-intake inner shell 26 and air-intake intermediate shell 29.

The second equation is a continuity equation which states that the rate of air flow downward through outer chimney duct 20 equals the total of the respective rates of air flow C of flue-cooling air upward through intermediate chimney duct 18 and the rates of discharge R and D of heated air into the room respectively through opening 70 and through heating ducts 53 and 58.

The third equation is a restatement of the second equation in which the quantity F has been replaced by its components.

A substitution of experimental data into the above-noted equations shows that two important objects of our invention have been fulfilled. First, the motor-driven blower in the air-intake assembly enables the rate of cooling air flow around the flue to be sharply increased. For example, the rate of flow T which occurs under pure thermosiphonic conditions in a typical installation is approximately 102 mass pounds per hour. By contrast, when blower 23 is operating at full speed in the same installation, the rate of flow C of cooling air around flue 15 is 967 mass pounds per hour. Thus, the rate of flow of flue-cooling air when blower 23 is in operation can be as much as nine times as great as it would be in the absence of an operating blower. A *typical* ratio between the rate of flow C of cooling air and the corresponding rate of flow I under pure thermosiphonic conditions is about 5. This ratio may prevail even when opening 70 from the fireplace to the room is not obstructed and when air flow through heating ducts 53 and 58 is also permitted.

Under the conditions just mentioned, the rate of flow F of air downward through outer chimney duct 20 is approximately 2,160 mass pounds per hour. Thus, about 1,200 mass pounds per hour of heated air are available for discharge into the room through the fireplace opening and through the heating ducts.

In the foregoing paragraphs, comparison has been made between the rate of flow of flue-cooling air when blower 23 is in operation and the rate of flow which would prevail by thermosiphonic action without the blower. Another meaningful comparison may be made between the rate of flow I which prevails between air-intake inner shell 26 and air-intake intermediate shell 29 with blower 23 in operation as compared with the approximate rate of flow T which would be present in the same location by virtue of thermosiphonic action alone. When blower 23 is in operation at high speed (typically employing about 1/5 horsepower to turn the blower at 1,050 r.p.m. and producing an air flow of about 1,960 mass pounds per hour) the air flow I between air-intake inner shell 26 and air-intake intermediate shell 29 is approximately 200 mass pounds per hour. This result approximately doubles the air flow which would take place by virtue of thermosiphonic action alone.

If blower 23 is operated at a lower power setting (typically consuming about 150 horsepower to turn the blower at 900 r.p.m. and causing a blower throughput of 1,480 mass pounds per hour), the rate of air flow between air-intake inner shell 26 and air-intake intermediate shell 29 is 155 mass pounds per hour. This is just over twice the rate of air flow which would prevail by virtue of thermosiphonic action alone. In summary, depending upon the power setting of motor 25, the air flow T which would result from thermosiphonic action has been multiplied by a factor ranging from about 1 ½ to 2.

Earlier in this specification, we have noted that a typical axial distance between the end of air-intake intermediate shell 29 and air-intake outer shell 27 is approximately 5 ¼ inches. If the end of air-intake intermediate shell 29 is *extended* so as to approach air-intake outer shell 27 more closely, the velocity of the air flowing between them can be increased, thereby causing a zone of sharply reduced static pressure in outer chimney duct 20. If that modification is made, the supplemental reduction of static pressure in outer chimney duct 20 may be such that the rate of air flow between air-intake inner shell 26 and air-intake intermediate shell 29 will be as much as *three times* the rate of flow T that would result from thermosiphonic action alone. Although this higher ratio is obtainable, we prefer the configuration illustrated in the drawings and earlier described in this specification, which produces a typical ratio of about 2 between the rates of flow I and T.

In the foregoing paragraphs, we have shown how the present invention has fulfilled one of its objectives in that cooling of the fireplace and flue is accomplished much more effectively than was possible prior to our invention. Another objective which we have been able to fulfill is the provision of heated air to the room either by direct discharge into the room or through the medium of ductwork carrying the heated air for discharge through registers. In typical fireplace systems incorporating our invention, outside atmospheric air may be discharged into the room at temperatures illustrated by the following examples:

If a fire generating 160,000 B.t.u. per hour is burning in a fireplace topped by a 20-foot chimney, and if the ambient air temperature outside the chimney top is 0° F, air can be discharged into the room at a temperature of approximately 95° F. If the ambient air temperature outside the chimney top of the same system is 35° F, air can be discharged into the room at a temperature of approximately 130° F.

If, in the same fireplace system with the same 20-foot chimney the rate of heat generation by the fire is increased to 200,000 B.t.u. per hour, and if the ambient air temperature outside the chimney top is 0° F, air can be discharged into the room at a temperature of approximately 120° F. For the same rate of heat generation in the same fireplace system, if the ambient air temperature outside the chimney top is increased to 35° F, air can be discharged into the room at a temperature of approximately 155° F.

The typical test data set forth in the preceding paragraphs indicate that a fire generating 160,000 B.t.u. per hour enables the fireplace to raise the temperature of outside atmospheric air by about 95° before the heated air is discharged into the room. If the rate of heat generation is increased to 200,000 B.t.u. per hour, the temperature of the outside air can be raised by about 120° F before discharge into the room.

In earlier paragraphs of this specification, data have been presented which demonstrate the effectiveness of the invention in cooling the three concentric pipes of the thermosiphonic chimney. There is *another* location in the fireplace system where practice of our invention also contributes to effective cooling. That location is a point in the fireplace system approximately one foot above the fireplace domes. At that point, the fireplace domes may be coupled to the chimney either directly or through a so-called "starter section." That particular location in a fireplace system tends to be a "hot spot" which is difficult to maintain at a satisfactory operating temperature. Employment of our invention with the blower in operation and with an ambient atmospheric temperature of 35° F causes the flue temperature to be reduced from 300° F to 194° F. Similarly the temperature of intermediate chimney pipe 17 at the same cross section is reduced from 180° F to 92° F. Finally, use of our invention causes the temperature of outer chimney pipe 19 at the same cross section to be reduced from 116° F to 70° F. Thus, an objective of cooling critical points in the fireplace-and-chimney system has been fulfilled by the practice of our invention.

While the assemblies, and components thereof, which have been described in this specification are those which we currently favor as being most practicable for use in residential buildings, we recognize that certain changes and adaptations can be made therein by persons skilled in the art without departing from the scope of our invention. Accordingly, our invention is to be defined in the following claims, as interpreted in the light of the foregoing descriptive material:

What we claim as new and desire to secure by Letters Patent of the United States is as follows:

1. A Thermal system comprising:

a. a thermosiphonic chimney having a flue, an intermediate chimney pipe and an outer chimney pipe concentric therewith and spaced successively outward therefrom whereby to define between said flue and said intermediate chimney pipe an intermediate chimney duct and whereby to define between said intermediate chimney pipe and said outer chimney pipe an outer chimney duct;

b. a heat source having an inner chamber and spaced successively outward therefrom an intermediate casing and an outer casing, said inner chamber being coupled to the flue of said thermosiphonic chimney, said intermediate casing being coupled to the intermediate chimney pipe of said thermosiphonic chimney, said outer casing being coupled to the outer chimney pipe of said thermosiphonic chimney, and the zone between said inner chamber and said intermediate casing being in communication with the zone between said intermediate casing and said outer casing;

c. air-intake assembly having a tapered structure mounted around the outer chimney pipe of said thermosiphonic chimney and d. means for impelling gas through said tapered structure into said outer chimney duct from a source external to said thermosiphonic chimney and for directing said gas through said outer chimney duct to the zone between said intermediate casing and said outer casing of said heat source; and e. outlet means associated with said heat source for delivering to a zone external to said heat source at least a portion of the gas impelled into said outer chimney duct and directed therethrough to said heat source.

2. The thermal system in accordance with claim 1 in which said outlet means comprises ductwork coupled to an opening in said outer casing of said heat source.

3. The thermal system in accordance with claim 1 in which said outlet means comprises ductwork coupled to an opening in said intermediate casing of said heat source.

4. The thermal system in accordance with claim 1 in which said outlet means comprises at least one opening in said outer casing of said heat source.

5. The thermal system in accordance with claim 4 in which said outlet opening is controllable.

6. The thermal system in accordance with claim 1 in which said means for impelling gas includes a blower.

7. The thermal system in accordance with claim 1 in which said means for impelling gas delivers to said outer chimney duct gas flow in addition to that which would be present by virtue of the thermosiphonic nature of said chimney.

8. An air-intake assembly for association with a thermosiphonic chimney, said air-intake assembly comprising:

a. a tapered structure adapted to be mounted around the outer chimney duct of said thermosiphonic chimney; and b. powered means for propelling air through said tapered structure into said outer chimney duct at a rate of flow such that a zone of lowered pressure is caused to exist within said outer chimney duct whereby air flow is induced from an external source into said outer chimney duct in a direction confluent with the air entering said outer chimney duct through said powered means.

9. The air-intake assembly in accordance with claim 8 in which said powered means comprises a motor-driven blower.

10. A fireplace assembly comprising a firebox and, spaced outwardly therefrom in succession, an intermediate fireplace casing and an outer fireplace casing, said firebox and said intermediate fireplace casing defining between them an intermediate zone and said intermediate fireplace casing and said outer fireplace casing defining between them an outer zone, said intermediate fireplace casing having a first opening therethrough whereby said intermediate zone is in communication with said outer zone, said fireplace assembly further comprising means for coupling a fireplace casing to at least one duct passing through said outer zone and coupled to a second opening in said intermediate fireplace casing for carrying away gas from at least one of said zones; and shield means mounted in said intermediate zone between said firebox and said second opening in said intermediate fireplace casing, for inhibiting radiation from said firebox from passing through said second opening in said intermediate fireplace casing and entering said duct.

11. The fireplace assembly in accordance with claim 10 in which at least one duct is coupled to an opening in said outer fireplace casing.

12. The fireplace assembly in accordance with claim 10 in which said outer fireplace casing has at least one opening whereby said outer zone is in communication with the space external to said fireplace assembly.

13. The thermal system in accordance with claim 1 in which said heat source defines a fireplace comprising a firebox, an intermediate fireplace casing surrounding said firebox and spaced therefrom, an outer fireplace casing surrounding said intermediate fireplace casing and spaced therefrom, a combustion dome coupled to said firebox for leading away combustion products from said firebox, an intermediate dome surrounding said combustion dome and spaced therefrom, said intermediate dome being coupled to said intermediate fireplace casing an outer dome surrounding said intermediate dome and spaced therefrom, said outer dome being coupled to said outer fireplace casing, said firebox having a frontal opening permitting passage of fuel and air into said firebox, an open duct mounted adjacent the frontal opening of said firebox following the outlines of at least portions of at least three sides of said frontal opening for furnishing make-up air to said firebox through said frontal opening, and an air-input duct coupled to said open duct for leading air into said open duct from the space adjacent said fireplace.

14. The thermal system in accordance with claim 13 in which said open duct is substantially rectangular in overall configuration and has respective portions adjacent all sides of the frontal opening of said firebox.

15. The thermal system in accordance with claim 13 in which said air-input duct is coupled to said open duct from the space below said fireplace and is substantially rectangular in cross section and is open at its interface with said open duct and at an end opposite said interface.

16. An air-intake assembly comprising:

a. a section of thermosiphonic chimney having a flue, an intermedite chimney pipe concentric with said flue and spaced therefrom, and an outer chimney pipe concentric with said intermediate chimney pipe and spaced therefrom in order to define therewith an outer chimney duct;

b. an air-intake outer shield having a frustoconical form and coupled to said outer chimney pipe around a circumference thereof, a cylindrical portion of said outer chimney pipe being cut away at a location axially spaced from the circumference of said outer chimney pipe to which said air-intake outer shell is coupled, whereby said intermediate chimney pipe forms with said air-intake outer shell and said outer chimney pipe in the vicinity of said cut-away portion of said outer chimney pipe an aspirator structure; and c. an air-intake duct coupled to said air-intake outer shell for delivering air thereto.

17. the air-intake assembly in accordance with claim 16 additionally comprising a motor-driven blower for forcing air into said air-intake duct.

18. The air-intake assembly in accordance with claim 16 additionally comprising at least one air-flow fin mounted between said outer chimney pipe and said air-intake outer shell.

19. The air-intake assembly in accordance with claim 18 in which said air-flow fin is attached to said air-intake outer shell and has a tapered form.

* * * * *